US005526105A

United States Patent [19]

Kenin et al.

[11] Patent Number: 5,526,105

[45] Date of Patent: Jun. 11, 1996

[54] ARTICULATED VACUUM TRANSPORT APPARATUS

[75] Inventors: Michael Kenin, Rochester; Steven L. Moore, Dansville; Larry T. Schlitzer, Rochester; David P. Dworzanski, Walworth, all of N.Y.

[73] Assignee: Eastman Kodak Company, Rochester, N.Y.

[21] Appl. No.: 355,799

[22] Filed: Dec. 14, 1994

[51] Int. Cl.[6] ..... G03G 15/00

[52] U.S. Cl. ..... 355/312; 271/3.23; 271/197

[58] Field of Search ..... 355/309, 312; 271/3.22, 3.23, 93–95, 4.06, 276, 197

[56] References Cited

U.S. PATENT DOCUMENTS

| | | | |
|---|---|---|---|
| 2,637,553 | 5/1953 | Ranger | 271/79 |
| 3,938,674 | 2/1976 | Kroeze et al. | 214/6 G |
| 3,945,635 | 3/1976 | Marin | 271/2.69 |
| 4,116,556 | 9/1978 | Tanaka et al. | 355/312 |
| 4,463,944 | 8/1984 | Granthan | 271/200 |
| 4,585,227 | 4/1986 | Muller | 271/270 |
| 4,790,224 | 12/1988 | Krutilla et al. | 83/53 |
| 4,861,014 | 8/1989 | Martin | 271/198 |
| 5,101,238 | 3/1992 | Creveling et al. | 355/271 |
| 5,101,241 | 3/1992 | Watanabe | 355/323 |
| 5,104,105 | 4/1992 | Cots et al. | 270/1.1 |
| 5,197,590 | 3/1993 | Prim et al. | 198/300 |
| 5,294,965 | 3/1994 | May | 355/312 |

*Primary Examiner*—Joan H. Pendegrass
*Attorney, Agent, or Firm*—Lawrence P. Kessler

[57] ABSTRACT

Apparatus for transporting sheets seriatim along a travel path from a first station to a downstream second station. The sheet transport apparatus comprises a housing in juxtaposition with the sheet travel path. A first transport assembly and a second transport assembly are respectively mounted within the housing. The second transport assembly is mounted in the housing, downstream in the direction of sheet transport, of the first transport assembly, for articulation relative to the first transport assembly, and so as to extend into operative relation with said sheet travel path for transporting a sheet respectively along a first portion of the sheet travel path and a second portion of the sheet travel path at an angle to the first portion.

13 Claims, 6 Drawing Sheets

ARTICULATED VACUUM TRANSPORT APPARATUS

BACKGROUND OF THE INVENTION

The present invention relates in general to apparatus for transporting sheets seriatim along a travel path and, more particularly, to an articulated vacuum transport apparatus.

In typical commercial electrostatographic reproduction apparatus (copier/duplicators, printers, or the like), a latent image charge pattern is formed on a uniformly charged dielectric member. Pigmented marking particles are attracted to the latent image charge pattern to develop such image on the dielectric member. A receiver member (for example, a cut sheet of plain bond paper) is then brought into contact with the dielectric member. An electric field, such as provided by an electrically biased roller, is applied so as to effect transfer of the marking particle developed image to the receiver member from the dielectric member. After transfer, the receiver member bearing the transferred image is separated from the dielectric member and transported away from the dielectric member to a fuser assembly at a downstream location. There the image is fixed to the receiver member by heat and/or pressure from the fuser assembly to form a permanent reproduction thereon.

It has been found that electrostatographic reproduction apparatus of the above described type at times exhibit a defect observable in image quality where the image over the trail edge of the receiver member is smeared. It has been determined that this particular image defect occurs, at least in part, when the lead edge of the receiver member enters the fuser assembly with the trail edge still in transfer association with the dielectric member. One reason for the cause of this defect is believed to be that transport disturbances induced by the fuser assembly are transmitted through the receiver member to the receiver member-dielectric member interface.

The problem of having the receiver member under simultaneous influence of the fuser assembly and the dielectric member can be readily overcome by insuring that the distance between the fuser assembly and the receiver member-dielectric member interface is greater than the length of the receiver member in the transport direction. However, this distance can become quite long when handling large size receiver members. The extended distance for the travel path complicates the construction of the transport and the associated elements of the reproduction apparatus. This is particularly significant as to the adjustability of the transport with regard to its location relative to the fuser assembly and the receiver member-dielectric member interface. Moreover, such extended distance has the further negative attribute in that it tends to unduly increase the overall dimensions of the reproduction apparatus.

SUMMARY OF THE INVENTION

In view of the foregoing discussion, this invention is directed to an apparatus for transporting sheets seriatim along a travel path from a first station to a downstream second station, such transport apparatus being readily adjustable and generally compact. The sheet transport apparatus comprises a housing in juxtaposition with the sheet travel path. A first transport assembly and a second transport assembly are respectively mounted within the housing. The second transport assembly is mounted in the housing, downstream in the direction of sheet transport, of the first transport assembly, for articulation relative to the first transport assembly, and so as to extend into operative relation with said sheet travel path for transporting a sheet respectively along a first portion of the sheet travel path and a second portion of the sheet travel path at an angle to the first portion.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
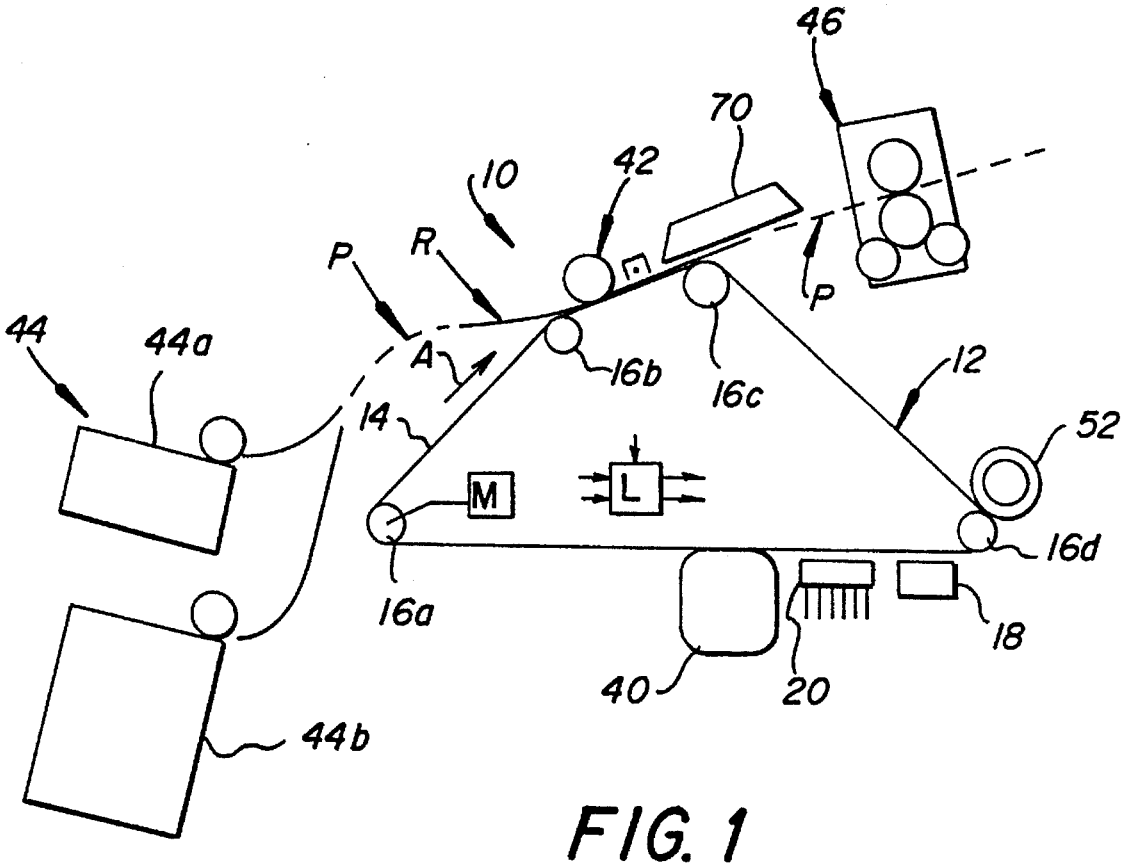
FIG. 1 is a schematic illustration of an electrostatographic reproduction apparatus including an articulated transport apparatus, according to this invention.
Figure 5:
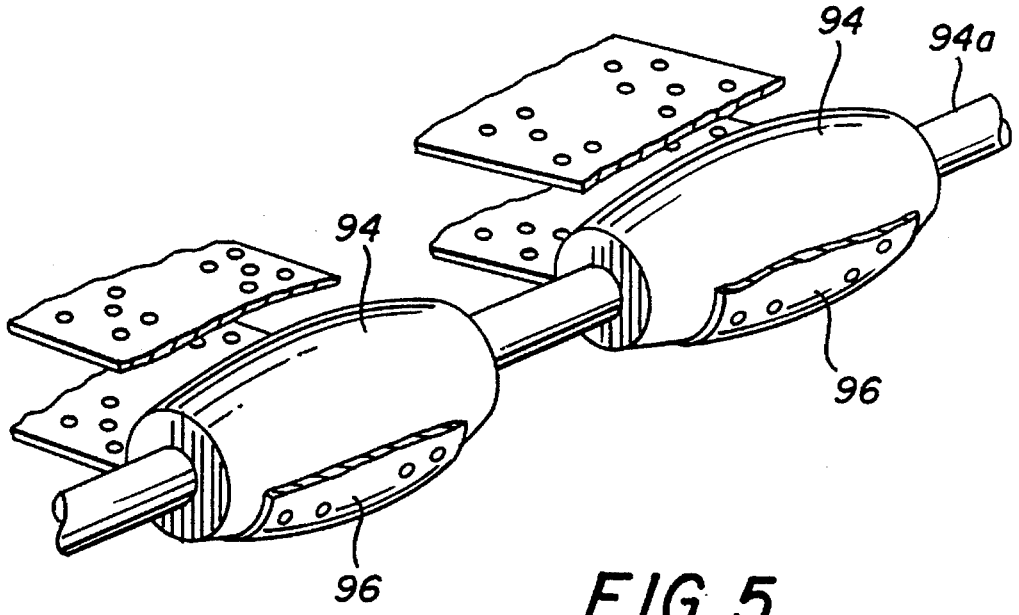
FIG. 5 is a view, in perspective and on an enlarged scale, of the crowned roller portion of the articulated vacuum transport apparatus of FIG. 2.
Figure 2:
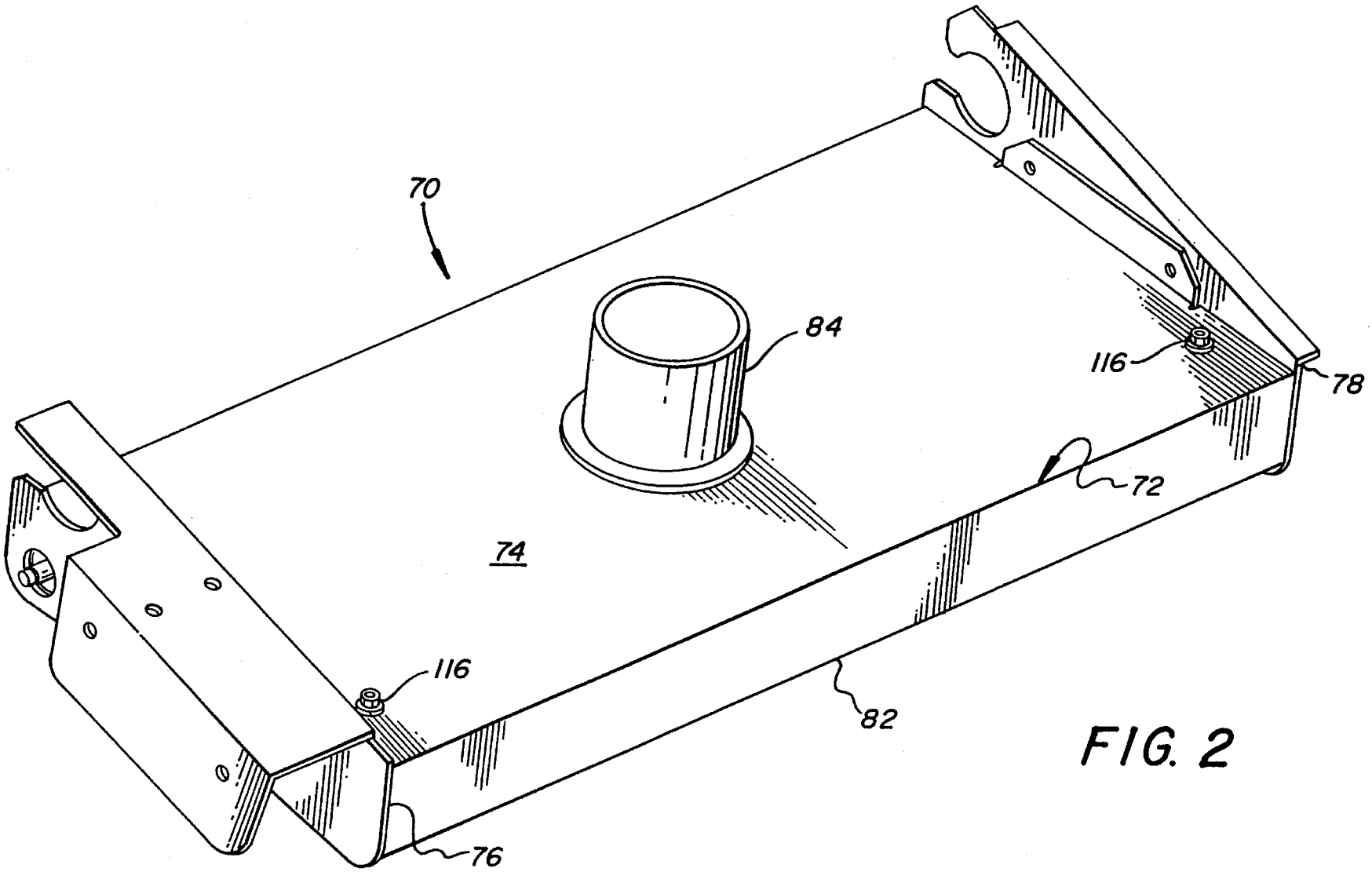
FIG. 2 is a top view, in perspective and on an enlarged scale, of the articulated vacuum transport apparatus, according to this invention.

Referring now to the accompanying drawings, an exemplary electrostatographic reproduction apparatus 10 is schematically shown in FIG. 1. The reproduction apparatus 10 includes a dielectric member 12 which is preferably an endless dielectric web 14 supported by rollers **16*a*–16*d*. One of the rollers (e.g., roller 16*a*) is driven by motor M to move the web about a closed loop path in the direction of arrow A. The web 14 is a composite structure having a photoconductive surface layer with a plurality of image receiving areas and a grounded conductive support layer. Typical electrographic process stations for forming transferable marking particle images on the web 14** are located about the periphery of the web in operative relation with the image receiving areas thereof.

Control of the reproduction apparatus 10 and the electrographic process stations are accomplished by a logic and control unit L including a microprocessor, for example. The microprocessor receives operator input signals and timing signals, for example, from sensors (not shown) detecting movement of the web 14 about its closed loop path. Based on such signals and a program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The electrographic process stations function in the following manner. A corona charger 18, coupled to a DC or biased AC electrical potential source (not shown), applies a uniform electrostatic charge to the web 14 as it moves past the charger. The uniform charge, in an image receiving area of the web, is altered as the web passes through an exposure zone to form an image-wise change pattern in such area corresponding to information to be copied. For example, the image-wise charge pattern is formed by exposure of the image-receiving area of the web to a light image of such information produced electronically, for example, by an LED array (shown schematically as element 20) or laser scanner. Of course, depending upon the composition of the dielectric web, the marking particles, and the desired duty cycle for the electronic exposure mechanism, the image-wise charge pattern may result from exposure of the given area of the web to that which is to represent the background of the information to be copied or exposure of the given area of the web to that which is to represent the particular information. The formation of a described image-wise charge pattern on the web may be alternately accomplished by other suitable methods such as by exposure to reflected light images.

As the web moves about its path, the area bearing the image-wise charge pattern is brought into operative relation with a developer station 40. The developer station 40 is, for example, of the type referred to as a magnetic brush. The magnetic brush of the developer station brings pigmented marking particles, electroscopically charged to a polarity opposite to that of the image-wise charge pattern on the web 14, into contact with the moving web. Such particles will then adhere to the image-wise charge pattern to develop the pattern on the web and form a transferable image.

Figure 7:
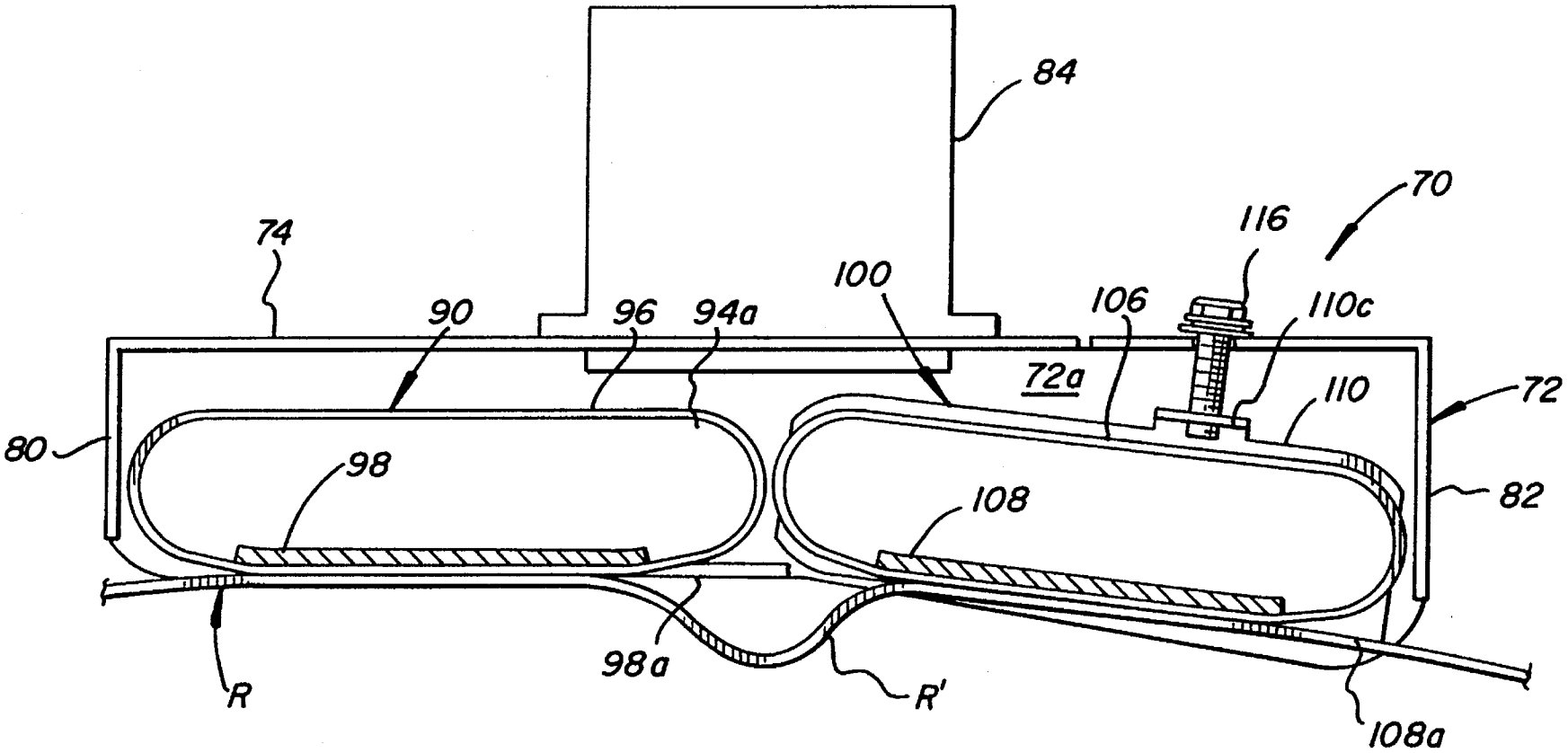
FIG. 7 is a side elevational view of the articulated vacuum transport apparatus according to this invention, particularly showing the transport of a sheet.

The image-receiving area of the web 14 containing the transferable image travels about the closed loop path to a transfer station 42 coupled to a DC, or biased AC, electrical potential source, for example. Receiver members (designated in FIGS. 1 and 7 of the drawings by the letter R), such as cut sheets of plain bond paper, are fed seriatim from a supply hopper 44 (plural supplies **44*a* and 44*b* may be used to contain sheets of different characteristics or dimensions). A respective receiver member is transported along a path P to the transfer station 42 in timed relation with the moving web 14 so that the receiver member is in register with the transferable image carried by the web. The transfer station 42 includes, for example, an electrically biased transfer roller, such as described in U.S. Pat. No. 5,101,238 (issued Mar. 31, 1992, in the name of Creveling, et al). The transfer roller establishes an electrostatic field to effect transfer of the transferable image from the web 14** to the receiver member.

After transfer of the transferable image to the receiver member, the receiver member is separated from the web 14 and transported by apparatus 70, according to this invention, along a continuation of path P to a fuser assembly 46. In the fuser assembly 46, the transferred image is fixed to the receiver member, for example, by heat and/or pressure. After the transferred image is fixed to the receiver member, the member is directed along a path to an output hopper or finishing apparatus (not shown) for operator retrieval. Substantially simultaneously with transport of the receiver member through the fuser assembly 46, the utilized image-receiving area of the web 14 moves through a cleaning station 52 where residual (non-transferred) marking particles are removed, for example, by a rotating fiber brush. Such image-receiving area of the web is then returned to the charger 18 to be conditioned (uniformly charged) for reuse.

The transport apparatus 70, according to this invention, is more particularly described with reference to FIGS. 2–7. Such transport apparatus includes a housing 72 defining an interior chamber **72*a* (see FIG. 4). The housing is adapted to be mounted within the reproduction apparatus 10 in relation to the receiver member travel path P as the receiver member is separated from and leaves the web 14. The chamber 72*a* is bounded by a top wall 74, a front wall 76, a rear wall 78, and side walls 80 and 82 of the housing 72. The bottom portion of the chamber 72*a* (in juxtaposition with the receiver member travel path P) is open relative to the receiver member travel path. A coupling 84 extends through the top wall 74 of the housing 72. The coupling 84, which is thus in flow communication with the interior housing chamber 72*a***, is connected to a vacuum source V (such as, for example, a suction fan) to enable the vacuum source to be in flow communication with the chamber.

A pair of transport assemblies 90, 100 are mounted in the housing 72 of the transport apparatus 70 to lie substantially within the chamber **72*a*. The transport assembly 90 includes an elongated roller 92 mounted on a drive shaft 92*a* and a plurality of crowned rollers 94 mounted in spaced relation along the longitudinal axis of an idler shaft 94*a* (see FIG. 5). The drive shaft 92*a* is supported for rotation in beatings 92*b* (only one shown in FIG. 3) carried respectively by the front wall 76 and the rear wall 78, while the idler shaft 94*a* is supported for rotation in bearings 94*b* (only one shown) carried respectively by the front wall and the rear wall. The bearings 92*b* and 94*b* are located such that the drive shaft 92*a* and the idler shaft 94*a*** are supported with the respective longitudinal axes thereof being substantially parallel.

A plurality of ported belts 96 are entrained about the plurality of crowned rollers 94 respectively and the elongated roller 92 (of course, the number of belts and corresponding number of crowned rollers is a matter of design choice). The respective runs of the ported belts 96 facing the receiver member travel path P are supported by a ported backing plate 98. The belt ports and the backing plate ports are arranged to periodically be in alignment for the purpose to be explained below. The backing plate 98 is connected to the front wall 76 (see FIG. 3) and the rear wall 78, and extends therebetween. The backing plate 98 also has a plurality of slotted extensions **98*a* which serve to span the area adjacent to the travel path P between the transport assembly 90 and the transport assembly 100**.

Figure 3:
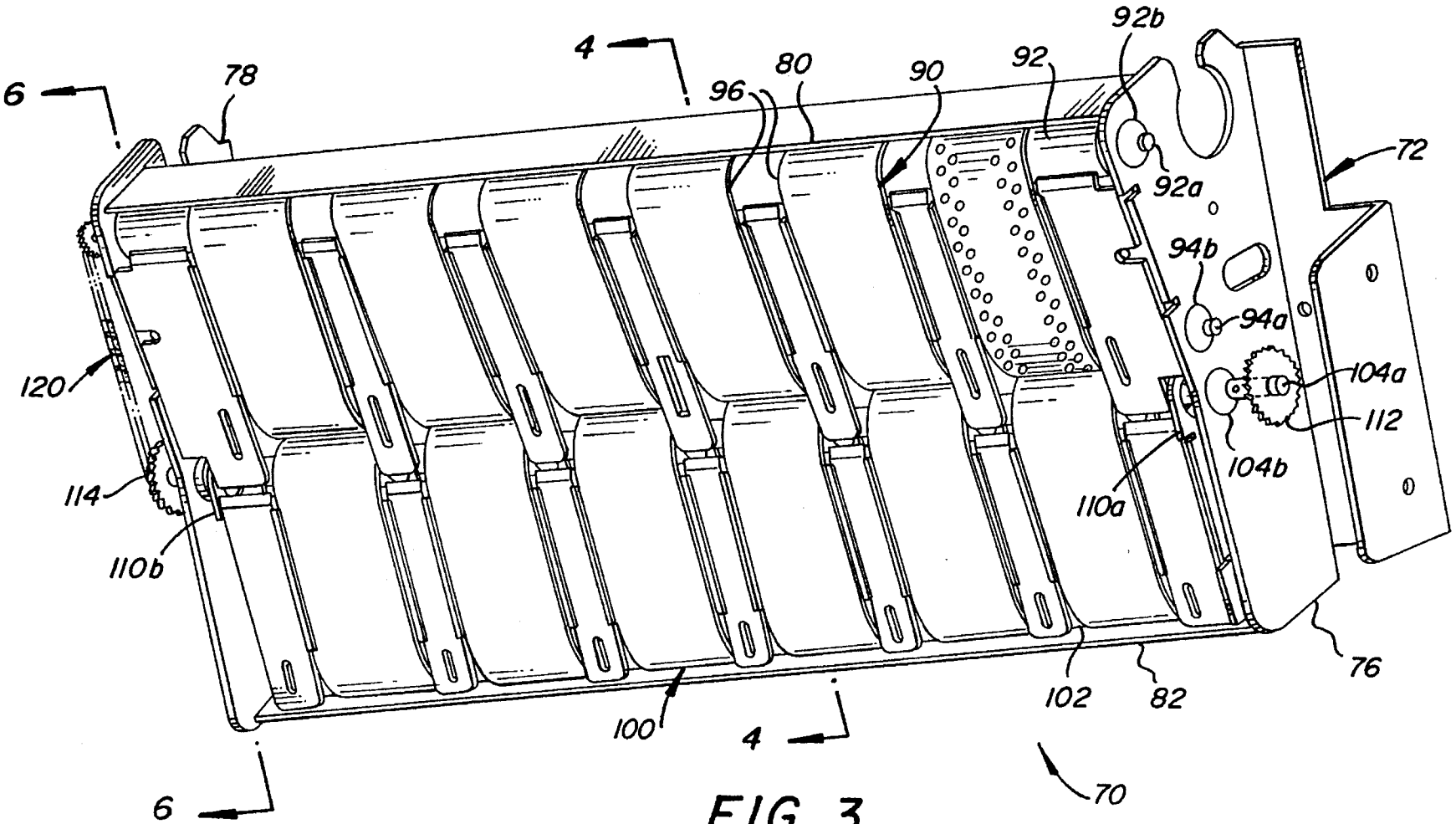
FIG. 3 is a bottom view, in perspective and on an enlarged scale, of the articulated vacuum transport apparatus of FIG. 2.
Figure 4:
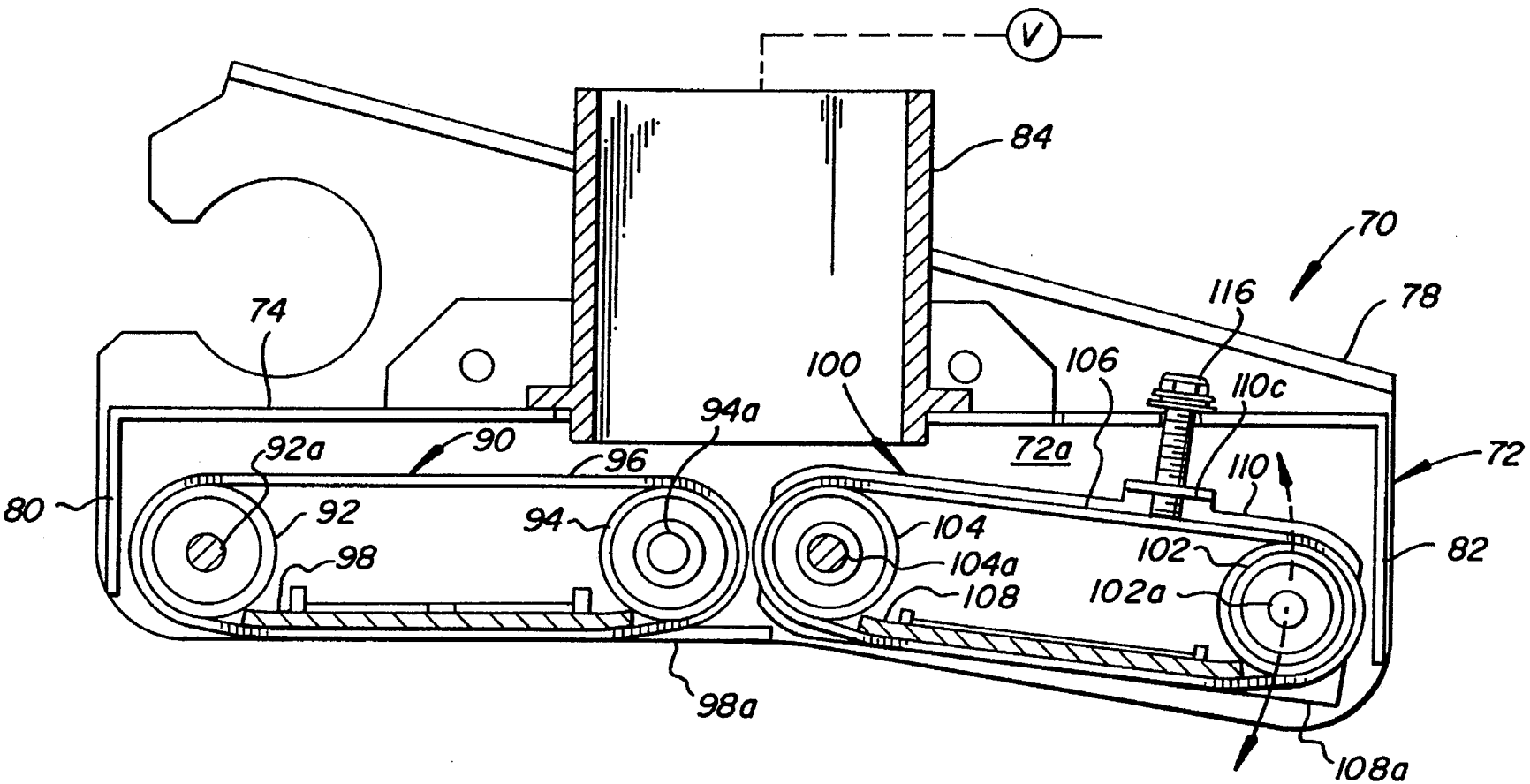
FIG. 4 is a side elevational view, partly in cross-section, taken along lines 4—4 of FIG. 3, of the articulated vacuum transport apparatus according to this invention with portions removed to facilitate viewing.
Figure 6:
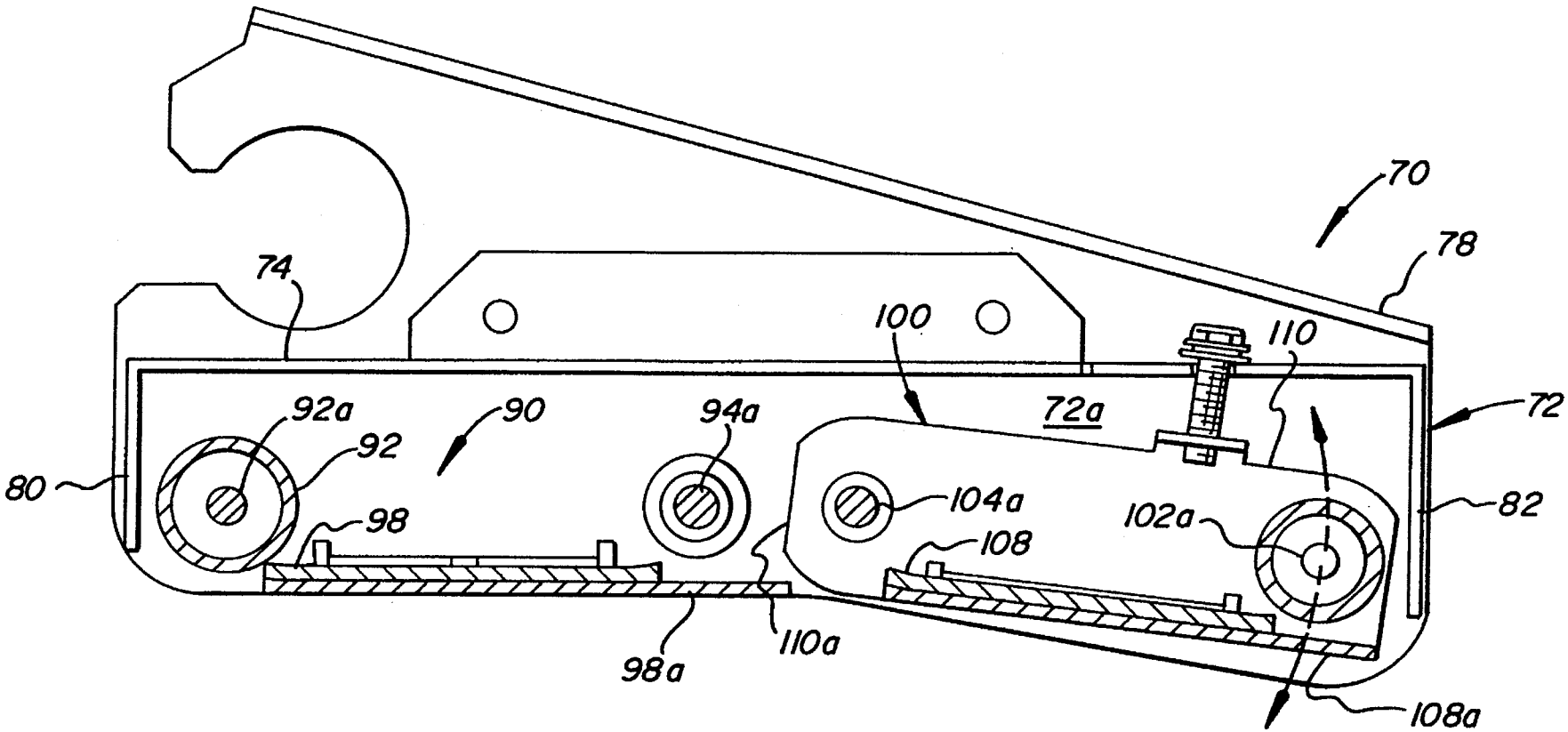
FIG. 6 is a side elevational view, partly in cross-section, taken along lines 6—6 of FIG. 3, of the articulated vacuum transport apparatus according to this invention with portions removed to facilitate viewing.

The drive shaft **92*a* is rotated in a counter-clockwise direction (when viewed as in FIG. 4) by a chain drive mechanism 120 (see FIG. 3). Rotation of the drive shaft 92*a* serves to cause the elongated roller 92 to urge the belts 96 for movement in a closed loop path in a like direction. The crowned shape for the rollers 94** substantially prevents the belts from mis-tracking, relative to the respective associated rollers.

In operation, the vacuum source V, in flow communication with the chamber **72*a*, will establish a sub-atmospheric condition within the chamber. Due to the periodic alignment of the ports in the belts 96 and in the backing plate 98, as the belts are moved, the sub-atmospheric condition serves through the aligned ports to attract a receiver member to the belts. Accordingly, the receiver member will be transported by the moving belts 96 along a first portion of the travel path P from the upstream station (i.e., in the illustrated embodiment, substantially detack from the web 14). The slots in the respective extensions 98*a* are also subjected to the influence of the sub-atmospheric condition such that the receiver member is attracted to the extensions as it is transported beyond the influence of the transport assembly 90 toward the transport assembly 100**.

The transport assembly 100 includes an elongated roller 102 mounted on an idler shaft 102*a*, and a plurality of crowned rollers 104 mounted in spaced relation along the longitudinal axis of a drive shaft 104*a*. The crowned rollers 104 are of the substantially the same construction and serve the same purpose (i.e., assure proper belt tracking) as the crowned rollers 94 shown in FIG. 5. The drive shaft 104*a* is supported for rotation in bearings 104*b* (only one shown in FIG. 3) carried, respectively, by the front wall 76 and the rear wall 78 of the transport apparatus housing 72. A frame assembly 110 is mounted on the drive shaft 104*a* for substantially free pivotable movement relative to the drive shaft. The idler shaft 102*a* is supported for rotation in bearings (not shown) carried, respectively, by the frame assembly 110. The bearings, respectively, support the drive shaft 104*a* and the idler shaft 102*a* such that the respective longitudinal axes of the drive and idler shafts are substantially parallel.

A plurality of ported belts 106 are entrained about the plurality of crowned rollers 104, respectively, and the elongated roller 102 (of course, the number of belts and corresponding number of crowned rollers is again a matter of design choice). The respective runs of the ported belts 106 facing the receiver member travel path P are supported by a ported backing plate 108, which forms a part of the frame 110. The backing plate 108 is connected to the walls 110*a* and 110*b* of the frame and extends therebetween (see FIG. 3). The belt ports and the backing plate ports are arranged to periodically be in alignment to enable a receiver member to be attracted to the belts 106 under the influence of the sub-atmospheric condition, similarly to the ports of transport assembly 90 as explained above. The backing plate 108 also has a plurality of slotted extensions 108*a* which serve to span the area adjacent to the travel path P downstream, in the direction of receiver member transport, of the transport assembly 100.

The drive shaft 104*a* is rotated in a counter-clockwise direction (when viewed as in FIG. 4) by a rotatable drive sprocket 112 mounted on the end of the drive shaft extending out-board of the wall 76 of the housing 72 (see FIG. 3). Rotation of the drive shaft 104*a* serves to cause the rollers 104 to urge the belts 106 for movement in closed loop path in a like direction. The shaft 104*a* also supports a drive sprocket 114 at the end of the drive shaft extending out-board of the wall 78 of the housing 72. The sprocket 114 forms a part of the chain drive mechanism 120. Accordingly, when the drive shaft 104*a* is rotated to move the belts 106, it will also actuate the chain drive mechanism 120 to rotate the drive shaft 92*a* of the transport assembly 90 as discussed above. It is, of course, apparent any other suitable mechanisms, such as belt drives or directly mounted motors, may be utilized with this invention to effect rotation of the drive shafts 92*a* and 104*a*.

Due to the periodic alignment of the ports in the belts 106 and the backing plate 108, as the belts are moved, the sub-atmospheric condition serves through the aligned ports to attract a receiver member to the belts. Accordingly, the receiver member will be transported by the moving belts 106 along a second portion of the travel path P, at an angle to the first portion of the travel path, toward the downstream station (i.e., in the illustrated embodiment, the fusing station 46). The slots in the respective extensions 108*a* of the backing plate 108 are also subjected to the influence of the sub-atmospheric condition such that the receiver member is attracted to the extensions as it is transported beyond the influence of the transport assembly 100.

According to this invention, the transport assemblies 90 and 100 of the transport apparatus 70 are mounted within the transport apparatus housing 72 for relative articulation to enable independent adjustment of the portions of the travel path P at the entrance to the transport apparatus and the exit therefrom. The housing 72 is mounted within the reproduction apparatus 10, in any suitable well known manner, to adjustably locate the entrance to the transport apparatus 70 relative to the area of separation of a receiver member from the web 14. On the other hand, relative articulation between the transport assemblies 90 and 100 is accomplished by the provision of adjustment screws 116 (see FIGS. 2, 4, and 6). The adjustment screws 116 extend through the top wall 74 of the housing 72, adjacent to the out-board walls 110*a*, 110*b* of the frame 110. The walls 110*a*, 110*b* of the frame 110, respectively, have adjustment screw receiving portions formed as bent-over tab-like elements 110*c* (one shown in FIG. 4) into which the screws 116 are operatively threaded. Accordingly, particular rotation of the screws 116 will result in a corresponding pivoting motion of the frame 110 about the longitudinal axis of the shaft 104*a*. Thus, the end of the transport assembly 100 most remote from the transport assembly 90 is adjusted to cause the transport assembly 100 to articulate relative to the transport assembly 90.

It is apparent that the independent adjustment of the portions of the travel path P at the entrance to the transport apparatus 70 and the exit therefrom, by the relative articulation of the transport assemblies 90 and 100, enables a bend in the path to be generated. As a result of this bend, the receiver member R being transported by the transport apparatus 70 will assume a like bend (see FIG. 7). This bend markedly reduces the beam strength of the receiver member in the direction of travel. The bend can then be used to generate a loop R' in the receiver member. The loop R' serves to absorb disturbances transmitted through the receiver member along the path P, such as to accommodate for transportation speed mis-matches for the receiver member between the upstream and downstream locations of the travel path. Thus, longer receiver members, in the travel direction (i.e., receiver members extending from the fuser assembly 46 back to the web 14), can be efficiently transported without creating image artifacts in the reproduction copy respectively formed thereon.

The invention has been described in detail with particular reference to preferred embodiment thereof, but it will be understood that variations and modifications can be effected within the spirit and scope of the invention as set forth in the claims.

What is claimed is:

1. Apparatus for transporting sheets seriatim along a travel path, said sheet transport apparatus comprising:

a housing in juxtaposition with the sheet travel path;

a first transport assembly including at least one belt mounted for movement about a closed loop path, with a run of said belt in juxtaposition with said first portion of said sheet travel path;

a second transport assembly; and means for mounting said first transport assembly in said housing, and for mounting said second transport assembly in said housing downstream, in the direction of sheet transport, of said first transport assembly for articulation relative to said first transport assembly, such that said first and second transport assemblies extend into operative relation with said sheet travel path for transporting a sheet respectively along a first portion of said sheet travel path and a second portion of the sheet travel path at an angle to said first portion.

2. The sheet transport apparatus according to claim 1 wherein said first transport assembly includes a drive shaft, an idler shaft substantially parallel to said first shaft and spaced in a downstream direction from said first shaft; means mounted on said first and second shafts for respectively supporting said at least one belt for movement about said closed loop path; and means for rotating said drive shaft to effect movement of said belt about said closed loop path.

3. The sheet transport apparatus according to claim 2 wherein said housing includes an interior chamber in flow communication with a vacuum source to create a sub-atmospheric condition within said chamber, and said belt defines a series of ports such that the sub-atmospheric pressure is effective through said series of ports to attract a sheet to said belt for transport therewith.

4. The sheet transport apparatus according to claim 1 wherein said second transport assembly includes at least one belt mounted for movement about a closed loop path, with a run of said belt in juxtaposition with said second portion of said sheet travel path.

5. The sheet transport apparatus according to claim 4 wherein said second transport assembly includes a drive shaft, an idler shaft substantially parallel to said first shaft and spaced in a downstream direction from said first shaft; means mounted on said first and second shafts for respectively supporting said at least one belt for movement about said closed loop path; and means for rotating said drive shaft to effect movement of said belt about said closed loop path.

6. The sheet transport apparatus according to claim 5 including a frame mounted adjacent one end on said drive shaft for pivotal movement about said drive shaft; means carried by said frame for supporting said idler shaft, and means for pivotably adjusting said frame about said drive shaft to move the idler shaft in an arc about said drive shaft.

7. The sheet transport apparatus according to claim 6 wherein said adjusting means includes at least one adjustment screw in operative association with a receiving portion of said frame.

8. The sheet transport apparatus according to claim 7 wherein said housing includes an interior chamber in flow communication with a vacuum source to create a sub-atmospheric condition within said chamber, and said belt defines a series of ports such that the sub-atmospheric pressure is effective through said series of ports to attract a sheet to said belt for transport therewith.

9. An electrostatographic reproduction apparatus comprising:

a dielectric member movable along a path, successive areas of said dielectric member adapted to respectively carry marking particle developed images, means for transferring a marking particle developed image from said dielectric member to a receiver member brought into operative association with said dielectric member, means for fixing the transferred marking particle image to said receiver member; and apparatus for transporting a receiver member along a travel path from said dielectric member after transfer of the developed image to said receiver member to said fixing means, said receiver member transport apparatus including a housing having an interior chamber and defining an opening in juxtaposition with the receiver member travel path; a first transport assembly; a second transport assembly; means for mounting said first transport assembly in said housing chamber, and for mounting said second transport assembly in said housing chamber downstream, in the direction of receiver member transport, of said first transport assembly for articulation relative to said first transport assembly, such that said first and second transport assemblies extend into operative relation with said receiver member travel path for transporting a receiver member respectively along a first portion of said receiver member travel path and a second portion of the receiver member travel path at an angle to said first portion; and means for adjusting the entrance of said first assembly relative to said transfer means, and the exit of said second assembly relative to said fixing means.

10. The electrostatographic reproduction apparatus according to claim 9 wherein said first transport assembly includes at least one belt mounted for movement about a closed loop path with a run of said belt in juxtaposition with said first portion of said receiver member travel path; and said second transport assembly includes at least one belt mounted for movement about a closed loop path with a run of said belt in juxtaposition with said second portion of said receiver member travel path.

11. The electrostatographic reproduction apparatus according to claim 10 wherein said first transport assembly includes a drive shaft, an idler shaft substantially parallel to said first shaft and spaced in a downstream direction from said first shaft; means mounted on said first and second shafts for respectively supporting said at least one belt for movement about said closed loop path with a run of said belt in juxtaposition with said travel path; and means for rotating said drive shaft to effect movement of said belt about said closed loop path; and said second transport assembly includes a drive shaft, an idler shaft substantially parallel to said first shaft and spaced in a downstream direction from said first shaft; means mounted on said first and second shafts for respectively supporting said at least one belt for movement about said closed loop path; and means for rotating said drive shaft to effect movement of said belt about said closed loop path.

12. The electrostatographic reproduction apparatus according to claim 11 including a frame mounted adjacent one end on said drive shaft of said second transport assembly for pivotal movement about said drive shaft; means carried by said frame for supporting said idler shaft of said second transport assembly, and means for pivotably adjusting said frame about said drive shaft to move the idler shaft in an arc about said drive shaft.

13. The electrostatographic reproduction apparatus according to claim 12 wherein said housing includes an interior chamber in flow communication with a vacuum source to create a sub-atmospheric condition within said chamber, and said belts of said first and second transport assemblies respectively define a series of ports such that the sub-atmospheric pressure is effective through said series of ports to attract a receiver member respectively to said belts for transport therewith.

* * * * *